US007252159B2

(12) United States Patent
Baek et al.

(10) Patent No.: US 7,252,159 B2
(45) Date of Patent: Aug. 7, 2007

(54) UNDERWATER ROCK BORING APPARATUS HAVING DIFFERENTIAL GLOBAL POSITIONING SYSTEM RECEIVER AND BORING METHOD THEREOF

(76) Inventors: In Suk Baek, 101-1205 Eden Geumho Town, 680-12 Dongsam 1-dong, Yeongdo-gu, Busan 606-807 (KR); Jong Seol Kim, 501 Jooyoung Villa, 16-3 Dongdaesin-dong 3-ga Seo-gu, Busan 602-812 (KR); Dae Woo Kang, 216-1702 Shingaegum LG Apt., 455 Gaegum-dong, Busanjin-gu, Busan 614-751 (KR)

( * ) Notice: Subject to any disclaimer, the term of this patent is extended or adjusted under 35 U.S.C. 154(b) by 285 days.

(21) Appl. No.: 10/892,363

(22) Filed: Jul. 14, 2004

(65) Prior Publication Data

US 2005/0121230 A1 Jun. 9, 2005

(30) Foreign Application Priority Data

Dec. 6, 2003 (KR) ..... 10-2003-0088353

(51) Int. Cl.
*E21B 7/128* (2006.01)

(52) U.S. Cl. ..... 175/7; 175/57; 166/354

(58) Field of Classification Search ..... 166/353, 166/354, 355; 175/7, 57, 161
See application file for complete search history.

(56) References Cited

U.S. PATENT DOCUMENTS 4,214,842 A * 7/1980 Franks ..... 405/191
4,770,255 A 9/1988 Barthelemy et al. ..... 175/6
4,972,907 A * 11/1990 Sellars, Jr. ..... 166/353
5,978,739 A * 11/1999 Stockton ..... 702/6
6,027,286 A * 2/2000 Pollack ..... 405/195.1
6,278,937 B1 * 8/2001 Ishida et al. ..... 701/207
6,601,649 B2 * 8/2003 Beato et al. ..... 166/352
7,080,689 B2 * 7/2006 Guesnon et al. ..... 166/355

FOREIGN PATENT DOCUMENTS

| | | |
|---|---|---|
| GB | 1029739 | 5/1966 |
| JP | 1280280 | 11/1989 |
| JP | 2002087763 | 3/2002 |
| KR | 00270251 | 7/2000 |

* cited by examiner

*Primary Examiner*—Thomas A Beach
(74) *Attorney, Agent, or Firm*—Sheridan Ross P.C.

(57) ABSTRACT

The present invention relates to an underwater rock boring apparatus having differential global positioning system receiver and boring method thereof, new boring technology—a satellite navigation device orients the accurate position of a target—is brought to the underwater boring technology.

A differential global positioning system (DGPS) receiver is provided at the body of a boring machine that is installed at the central opening of a self elevation platform (SEP) barge, the location of the boring machine is set to concentricity of the target boring position, and the position of the hull can be controlled without any movement of the boring machine. Then, the barge quickly moves to the next target boring location owing to the operation of a hull moving means so that the construction efficiency of the boring work can be enhanced.

8 Claims, 10 Drawing Sheets

- PRIOR ART -

- PRIOR ART -

UNDERWATER ROCK BORING APPARATUS HAVING DIFFERENTIAL GLOBAL POSITIONING SYSTEM RECEIVER AND BORING METHOD THEREOF

BACKGROUND OF THE INVENTION

1. Field of the Invention

The present invention relates to an underwater rock boring apparatus having differential global positioning system receiver and underwater rock boring method thereof, and particularly the former in which a differential global positioning system (DGPS) receiver is provided at the body of a boring machine that is installed at the central opening of a self elevation platform (SEP) barge; a location data of the boring machine is received from a satellite and a reference station to bore in the underwater rock at an accurate boring location; and the barge quickly moves to the boring location so that the construction efficiency of the boring work can be enhanced.

2. Description of the Prior Art

In examples, such as a pier groundwork for an underwater bridge structure, a sea structure construction for specific purpose, a development of a waterway for a large ship, and a berth construction for a large ship, the rock existed at the spot in an underway will be bored, a diver loads detonator and charge into the bore—the detonator and charge have a predetermined size and made at the outside, the bore is sealed by an underwater material such as stone, sand, and soil, the explosive is detonated to crush the underwater rock, and finally the spot has to be flattened.

In the boring work, the winches—installed on the barge that has the boring machine—are operated to wind or release the wire ropes. Anchors of above 1.5~2.5 ton that are connected to respective wire ropes are far away from the barge at more than 150~200 m. The anchors are dropped on the rock and the barge stops; next the rod of the boring machine is lowered and rotated so that the underwater rock can be bored.

One example of the prior art for the boring of the underwater rock is disclosed in Korean Publication Patent No. 10-0270251. As shown in FIGS. 1*a* and 1*b*, at one edge of a barge 1 is installed a platform 4 which is at a predetermined interval and the platform 4 is comprised of a vertical platform 2 and a horizontal platform 3. The rail 5 that is flush with the surface of the barge 1 is installed at the platform 4. A conventional land-boring machine 7 has a casing 6 that operates up and down and has a driving wheel 8 at each end of the land-boring machine 7. Each driving wheel 8 is placed on the rail 5 of the platform 4 and one side edge of the barge 1. The land-boring machine 7 moves longitudinally.

The above prior art assumes the form in which crawler drill used as the land boring machine 7 is loaded on the barge 1, and the platform 4 made from a H-beam is constructed at the one side border of the barge. The crawler drill is placed on the platform and moves forward/backward along the rail 5. The barge and the boring machine can be independently operated so that the boring work is executed.

However, in the boring work of the sea, a barge is swayed 20~30 cm owing to waves. When a large vessel comes by the barge that is executing the boring work, the height of the wave increases above 60 cm and the force of the wave creates a wide swing of the barge.

Therefore, if the barge rolls or pitches heavily from the power of the wave, in addition to the swing of the barge, the crawler drill loaded on the barge is shaken about the center of the support point of the rod and the bit of the crawler drill. The rod can be broken, which causes a problem with the boring work.

Further, since the crawler drill is located at the side boarder of the platform offset from the center of the barge, there is a potential problem of instability because the rods installed the crawler drill can fall into the underwater.

Furthermore, when a change of the boring position is required, the crawler drill must be moved along the rail, and so the boring equipment is knocked down and then the knockdown parts are assembled at the next target boring position. It is attended with difficulties in the boring work. It normally takes more than 30 minutes to move the next boring position, thus bringing the problem of inefficiency caused by the slow process of the boring work.

In addition, when the length of the rod is about 3 m, and the diameter of the rod is 75 mm, the rod weighs 18 kg. According to the handling of the rod, there is no choice but to adapt the diameter of the rod to have less than 75 mm. (if adapting the diameter of the bit having 105 mm, the weight of the rod increases up to 22 kg, and the center of the machine can be swayed.) There is a limitation in increasing the diameter of the rod. As the blasting hole having a small diameter (e.g. 75 mm) is dug, the position of the digging is inaccurate. And also, since the small diameter of the boring hole has the increased volume of charge, it has the disadvantage that not much blast effect can be obtained.

Furthermore, if the prior art is adopted where a silt of the underwater covers the underwater rock, the silt around the blast hole having the small diameter or the rock debris go into the blast hole, which makes the charge loading difficult. Generally, the blocking ratio of the boring hole amounts to 20~30% and it requires additional boring work. Otherwise, the charge must stick on the outer surface of the rock, which is inconvenient.

To solve the problem, the inventors suggest new boring technology in which a satellite navigation device orients the accurate position of a target and the device is brought to the underwater boring technology.

In general, Global Positioning System is a system for accurately detecting target's position using a satellite. With the GPS receiver, accurate time and distance from more than 3 satellites are measured; the present position is accurately attained using a triangular method. This is applied to simple positioning information, defense, sea development, investigation of sea resources, automatic navigation for plane, ship, and car, traffic control, prevention of oil tank collision, accurate survey of engineering works, and map production, etc.

DGPS (Differential Global Position System) is a position detecting apparatus by which the satellite signal is received from a satellite and a compensation signal is received from a DGPS reference station that is installed at the already known position of the land. The position of a ship can accurately be detected even in the open sea. The DGPS is a lightweight apparatus, which is comprised of an antenna receiving the satellite signal, a RF (radio frequency) unit extracting the desirable signal from the satellite signal, a computing unit processing the desirable signal, and a user interface unit.

The apparatus is a modular GPS system that can measure the position far from the GPS satellite and the reference station. It can operate continuously for 24 hours. Location information with high accuracy can be attained through the observation process in Real Time Kinematics (RTK) in the quick initialization and the lower power.

Therefore, the present invention is devised to solve the problems. A differential global positioning system (DGPS) receiver is provided at the body of a boring machine that is installed at the central opening of a self elevation platform (SEP) barge, the location of the boring machine is set to concentricity of the target boring position (DGPS boring error; less than 2 cm), and the position of the hull can be controlled without any movement of the boring machine. Then, the barge quickly moves to the next target boring location so that the construction efficiency of the boring work can be enhanced.

SUMMARY OF THE INVENTION

It is an object of the present invention to provide an underwater rock boring apparatus having a differential global positioning system receiver and boring method thereof, in which technology of DGPS is brought to the boring technology, and a boring machine that is installed at the central opening of the barge is concentric to the target underwater rock so that accurate boring can be attained.

It is another object of the present invention to provide an underwater rock boring apparatus having a differential global positioning system receiver and boring method thereof, in which the position movement of the boring work can be done quickly without movement of the boring machine as well as without a troublesome knock down of the parts, thus enhancing the efficiency of the construction.

It is another object of the present invention to provide an underwater rock boring apparatus having a differential global positioning system receiver and boring method thereof, in which the boring machine is provided at the center of the barge without direct influence from waves or other exterior forces, and making connection of the rod to be easy, and enabling the boring work having a large diameter executed, and so achieving the blasting and crushing work for underwater rock efficiently.

It is another object of the present invention to provide an underwater rock boring apparatus having a differential global positioning system receiver and boring method thereof, in which the breakage of the boring machine rod can be prevented despite the swaying of the hull, thus proceeding with the work continuously.

In order to accomplish those and these objects, the present invention has characteristic in which; an underwater rock boring apparatus having a differential global positioning system receiver is comprised of:

a boring machine installed at the upper portion of the opening that provided at a barge hull, and having a differential global positioning system (DGPS) receiver at a predetermined location of the body thereof;

a differential global positioning system (DGPS) in which the DGPS receiver attached on the boring machine receives location data from a satellite and a reference station and DGPS receiver sends the received data to a control means through a cable;

a boring data memory means for storing a boring map that displays both boring target location of an underwater rock and boring location data that are entered through an input means;

a display means that respectively displays the location of the boring machine and the boring target location of an underwater rock and monitors the entire procedure;

a hull moving means for controlling a location of the hull having the boring machine; and a controller for controlling that both boring location data received from the boring data memory means and location data of the boring machine received from the DGPS are to be displayed on the display means, and for controlling that the hull moving means controls the location of the hull having the boring machine.

Further, it has another characteristic in that the DGPS receiver is attached at the upper part of the boring machine that is coaxial to the rod of the boring machine.

Further, it has another characteristic in that the hull moving means comprises plural winches that are installed on the barge; a winch driver for driving plural winches under command of the controller; and plural wire ropes that are wound on respective winches, and are connected to respective anchors dropped on an underwater rock via direction diverters that are respectively installed at four corners of the barge.

Further, it has another characteristic in that the winch driver operates a forward and a reverse rotation and a stop by the operation of each winch under command of the controller.

Further, it has another characteristic in that the hull moving means is driven under command of the controller, and winches placed in the same direction as the hull moving direction run to pull the wire rope, and winches placed in the opposite direction to the hull moving direction run to release the wire rope.

Further, it has another characteristic in that the input means is a scanner or a keyboard.

Furthermore, it has another characteristic in that an underwater rock boring method using a boring machine having a differential global positioning system receiver is comprised of:

a) an initializing set-up step in which a barge that has the boring machine with the DGPS receiver on the center of the barge moves above the rock to be bored; anchors of the barge are operated by plural winches and plural wire ropes; the anchors are dropped on the rock that is far away from the hull at a predetermined distance and the barge stops; next, the boring program installed on the controller operates; the controller receives the present position data of the barge from the DGPS; the XY plane with the origin of the present position is established on the display means; and the boring map and the boring data are stored in the boring data memory means to display the target boring position of the underwater rock on the display means;

b) a displaying step in which the target boring position oriented from the boring data memory means and the position of the boring machine inputted from the DGPS are displayed on the display means with the XY plane;

c) a decision step in which it is determined whether or not the position of the target boring corresponds with the position of the boring machine;

d) a hull location control step in which if it does not correspond, the winch driver is driven under command of the controller so as to move the hull;

e) an excavation step in which when the position of the boring machine does correspond with the target boring position, the rod and the bit of the boring machine are lowered through the opening of the barge, and start to bore the underwater rock;

f) a hull movement step in which as the rock boring work for the target boring position is completed, the hull is moved to the next target boring position; and the above processes b)~f) are repeatedly operated.

Further, it has another characteristic in that the hull location control step and the hull movement step are the following steps: the winch driver operates under command of the controller; plural wire ropes wound on each winch are connected to respective anchors through the direction switch guider; the wire rope installed to move in a predetermined direction is wound and the wire rope installed to move in the opposite direction is released, thus achieving the movement of the hull.

BRIEF DESCRIPTION OF DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
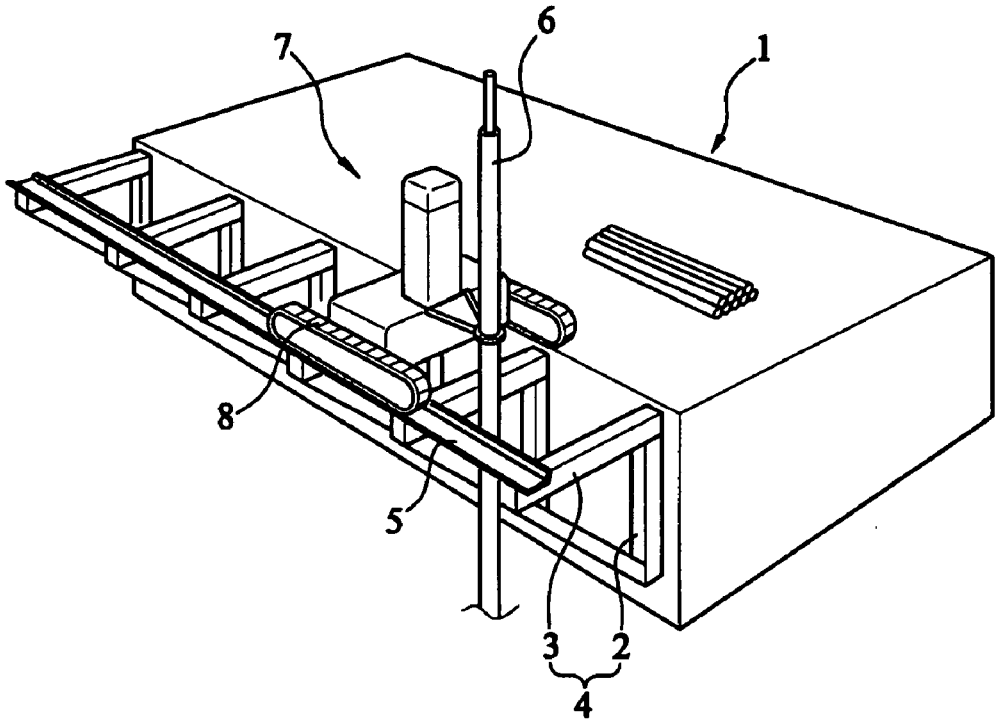
FIG. 1*a* is a perspective view of a boring machine according to a prior art.
Figure 1B:
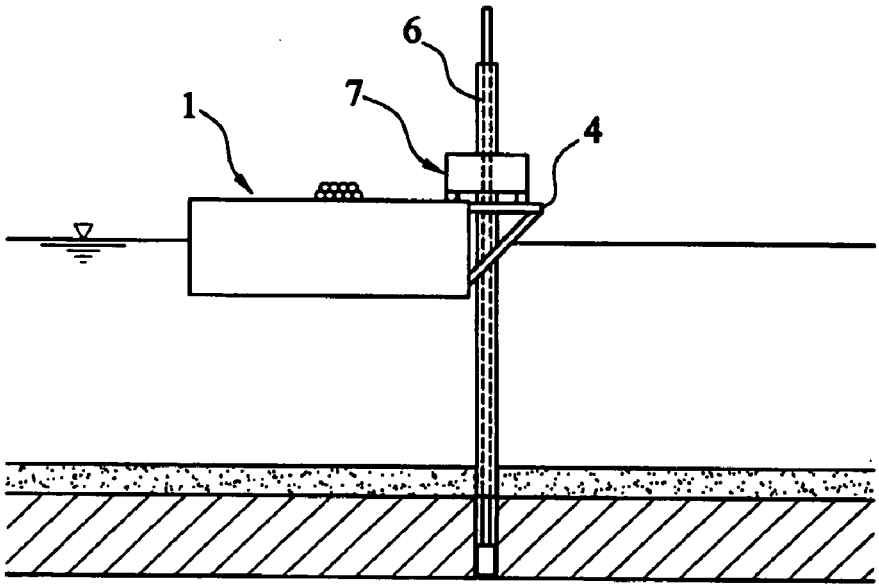
FIG. 1*b* is a side cross-sectional view of a boring machine according to a prior art.

Reference should now be made to the drawings, in which the same reference numerals are used throughout the different drawings to designate same or similar components.

Figure 2A:
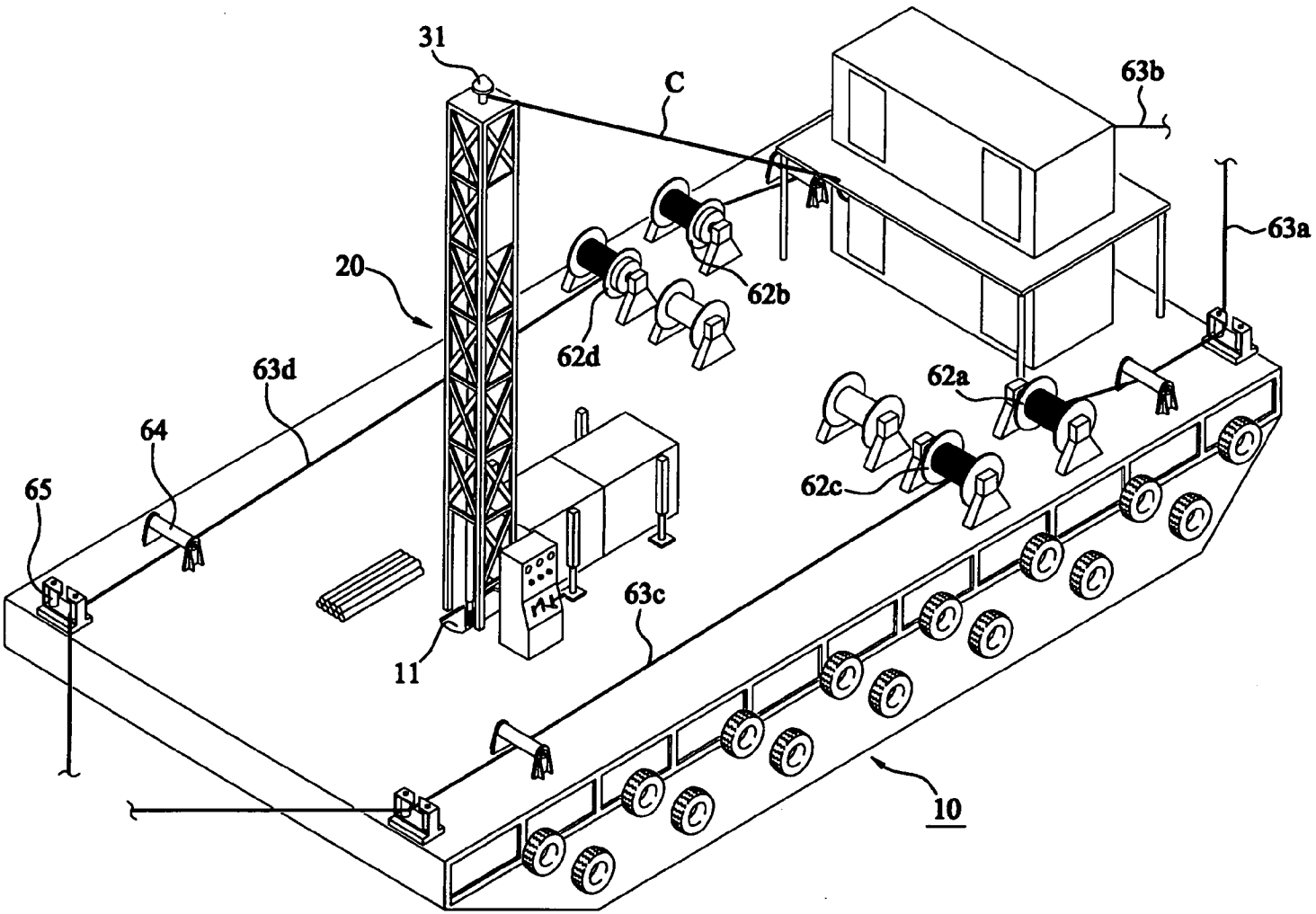
FIG. 2*a* is a perspective view of a barge that carries a boring machine having a differential global positioning system (DGPS) receiver for an underwater rock according to the present invention.
Figure 2B:
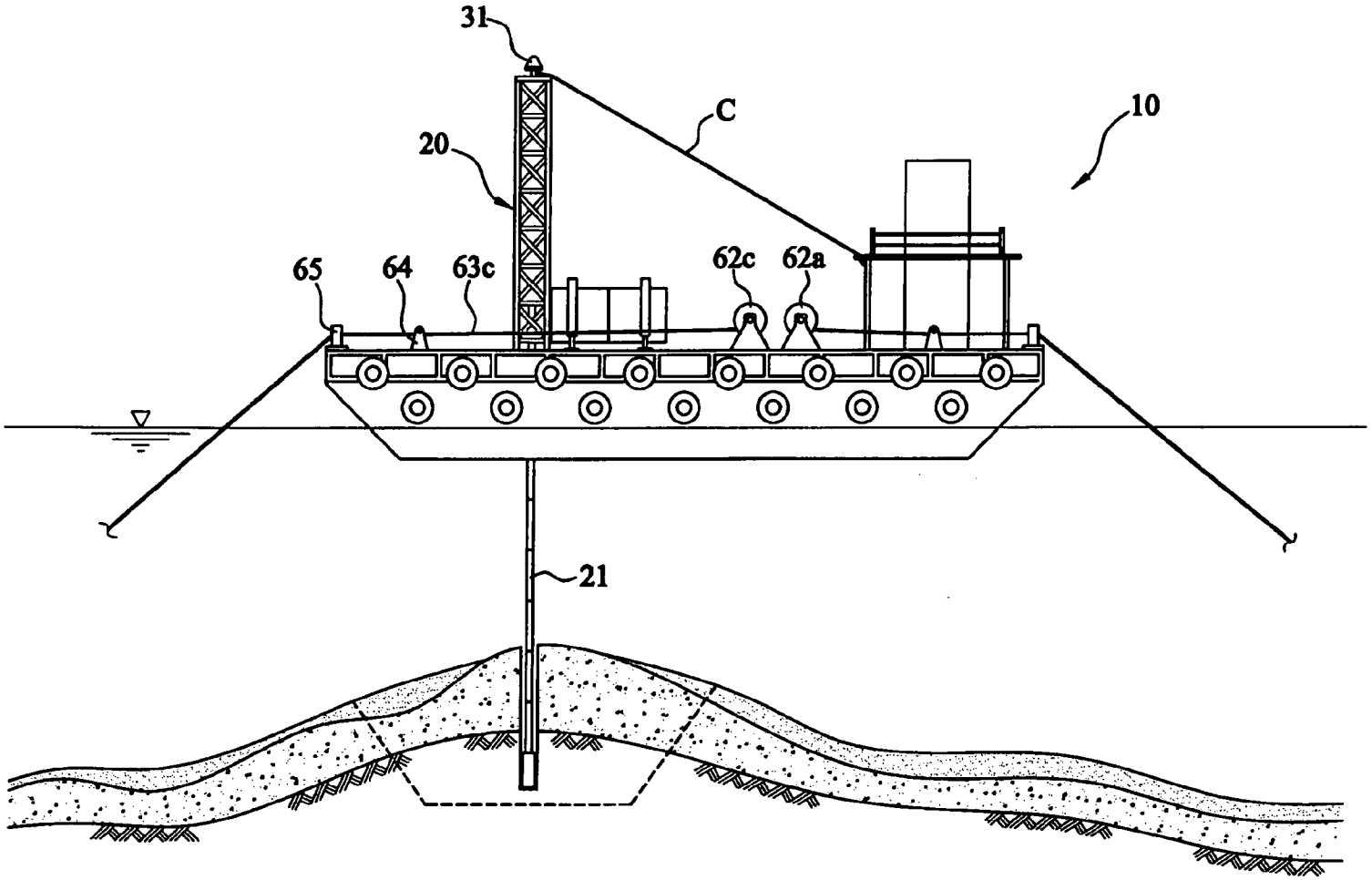
FIG. 2*b* is a side cross-sectional view illustrating that the barge stops at the sea to be bored and performs the boring work.

FIG. 2*a* is a perspective view of a barge that carries a boring machine having a differential global positioning system (DGPS) receiver for an underwater rock according to the present invention, and FIG. 2*b* is a side cross-sectional view illustrating that the barge stops at the sea to be bored and performs the boring work.

As shown in FIGS. 2*a* and 2*b*, a barge 10 has plural winches 62*a*, 62*b*, 62*c*, 62*d* installed on the barge 10, and respective wire ropes 63*a*, 63*b*, 63*c*, 63*d* are wound on respective winches 62*a*, 62*b*, 62*c*, 62*d*. The anchors (not shown) connected to plural wire ropes 63*a*, 63*b*, 63*c*, 63*d* are dropped on the underwater rock distanced at a predetermined length from each corner of the barge 10 so as to moor the barge 10.

The barge has an opening 11 with a predetermined size at the center of the hull. The preventive boring machine 20 is installed over the opening 11 so as not to have a direct effect from a force of waves. A bit and rod 21 for the boring machine move up and down through the opening 11. Thus, the boring machine 20 is set to easily approach the underwater rock.

In addition, the DGPS receiver 31 is provided at a predetermined location of the body thereof, preferably, at the upper part of the boring machine that is coaxial to the rod 21 of the boring machine 20. Location information of the boring machine 20 is received from a satellite and a reference station through a cable C and is sent to a controller (not shown).

Figure 3:
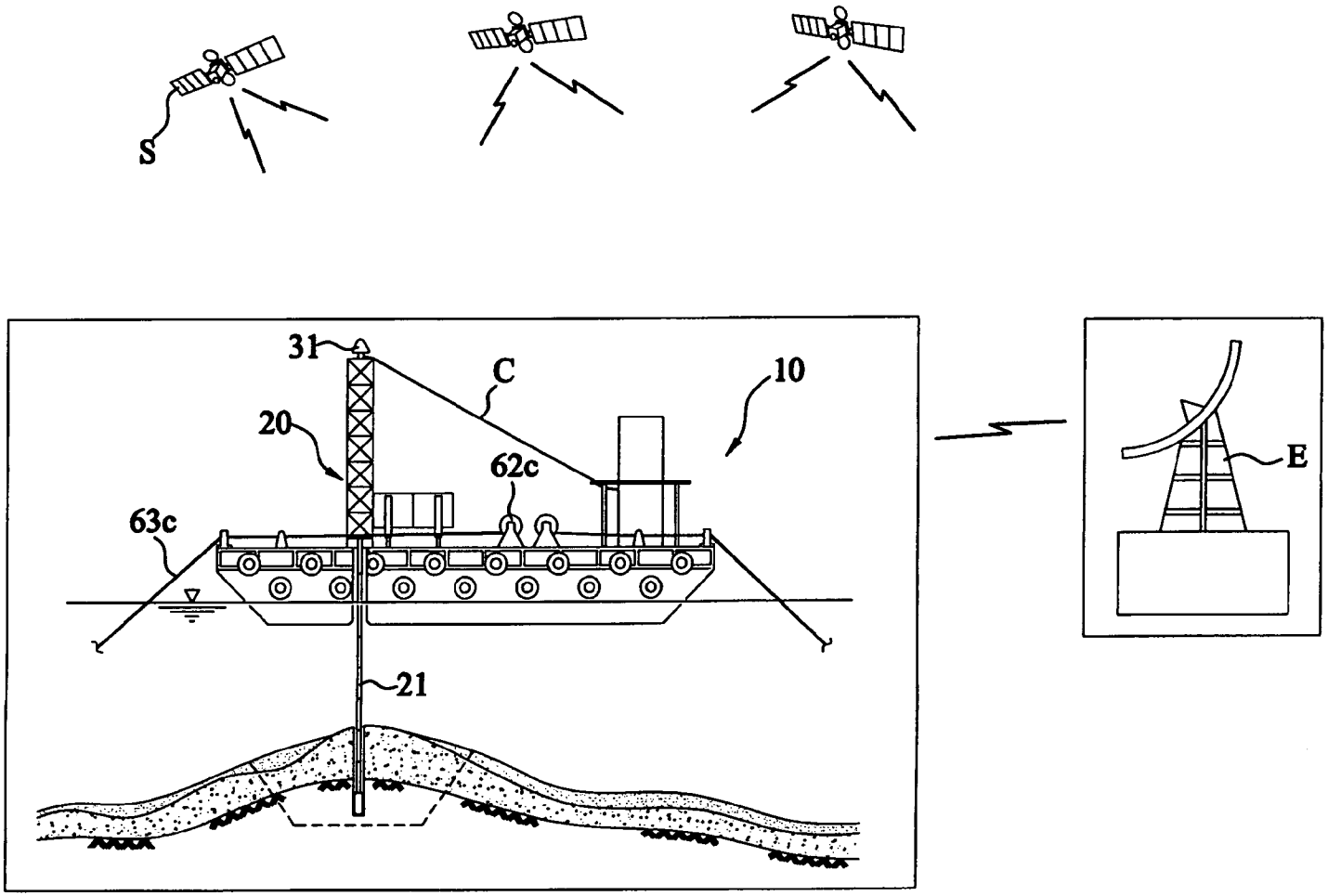
FIG. 3 is a schematic view illustrating that the underwater rock boring apparatus—having the DGPS receiver—bores the underwater rock.

FIG. 3 is a schematic view illustrating that the boring machine—having the DGPS receiver—bores the underwater rock, and the DGPS receiver gets location information of the boring machine from a satellite and a reference station.

The GPS satellite S sends the signal to the user. The signal has information regarding the location of the satellite and the distance from the satellite to the boring machine. The DGPS receiver 31 receives the signals from more than 3 GPS satellites to acquire the location information of the DGPS receiver 31. The distance between the GPS satellite and the GPS receiver is obtained by measuring the transmission time of a radio wave. At this time, the time between the GPS satellite and the GPS receiver must be accurately synchronized.

DGPS (Differential GPS) is the system in which the reference station, of which the position is already known, calculates the error component of a pseudo range measuring value using information sent from the satellite S, and the result value is given to the user, who can make an accurate decision about the position.

In the DGPS system, the position of the DGPS receiver 31—that is measured at the reference station E in advance—is compared with the position calculated using the GPS signal received from the satellite S. It calculates a correction message of position error at that moment. The information is sent to the DGPS receiver 31 with RTCM (Radio Technical Commission for Maritime) format (that is a standard format respect to correction message transfer), and thus is reflected in the position's calculation, and positioned accurately by user.

In the invention, the DGPS system is applied to a boring work. The position of a boring machine loaded on the barge makes a coaxial position of the underwater rock to be crushed, thus boring the underwater rock accurately.

Figure 4:
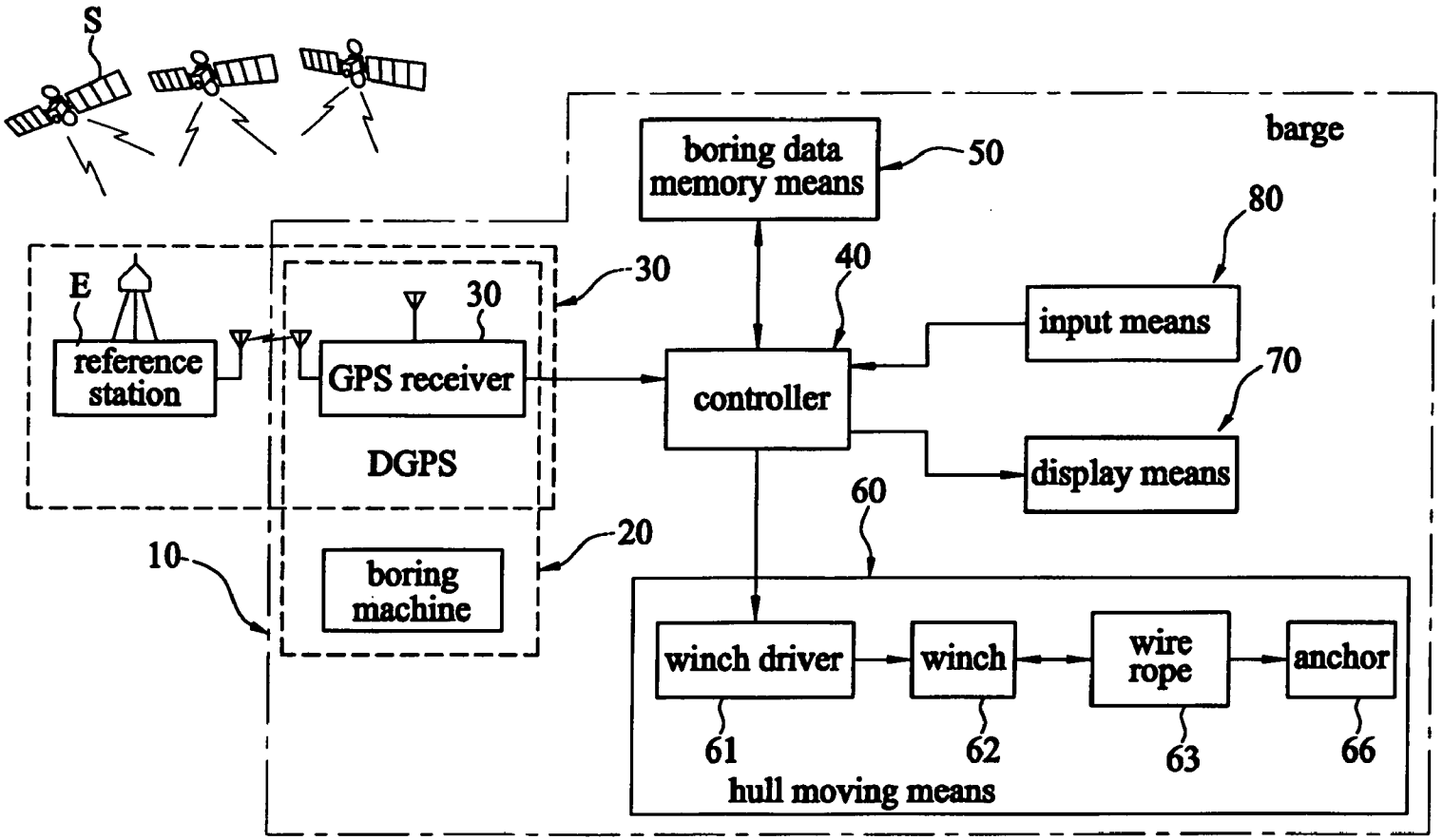
FIG. 4 is a block diagram illustrating the components of the underwater rock boring apparatus having a differential global position system receiver for the underwater rock according to the invention.

FIG. 4 is a block diagram illustrating the components of the underwater rock boring apparatus having a differential global position system receiver for the underwater rock according to the invention. The underwater rock boring apparatus is comprised of a barge 10, a boring machine 20, a satellite S, a DGPS for the receiving position signal from a reference station E, a controller 40, a boring data memory means 50, a hull moving means 60, a display means 70, and an input means.

The DGPS 30 is comprised of the reference station E that compares its position measured in advance and the calculated position using the GPS signal, and it computes the correction message according to GPS signal at that moment. Further, the DGPS 30 has the DGPS receiver 31 which is provided at the body of the boring machine 20, corrects the GPS signal's difference received from the GPS satellite S using the correction message received from the reference station E, and outputs the position data of the boring machine to the controller 40.

The controller 40 stores the boring program in its built-in memory. According to the program, the position data of the boring machine received from the DGPS 30 and the position data of the boring target read from the boring data memory means 50 (which will be explained later) are displayed respectively on the display means 70. Further, the controller 40 controls operation of the hull moving means 60 which controls the position of the hull that has the boring machine 20.

In the boring data memory means 50, the position data for the boring target of the underwater rock and its boring map are inputted by the input means such as a scanner and a keyboard. They are stored.

Figure 8:
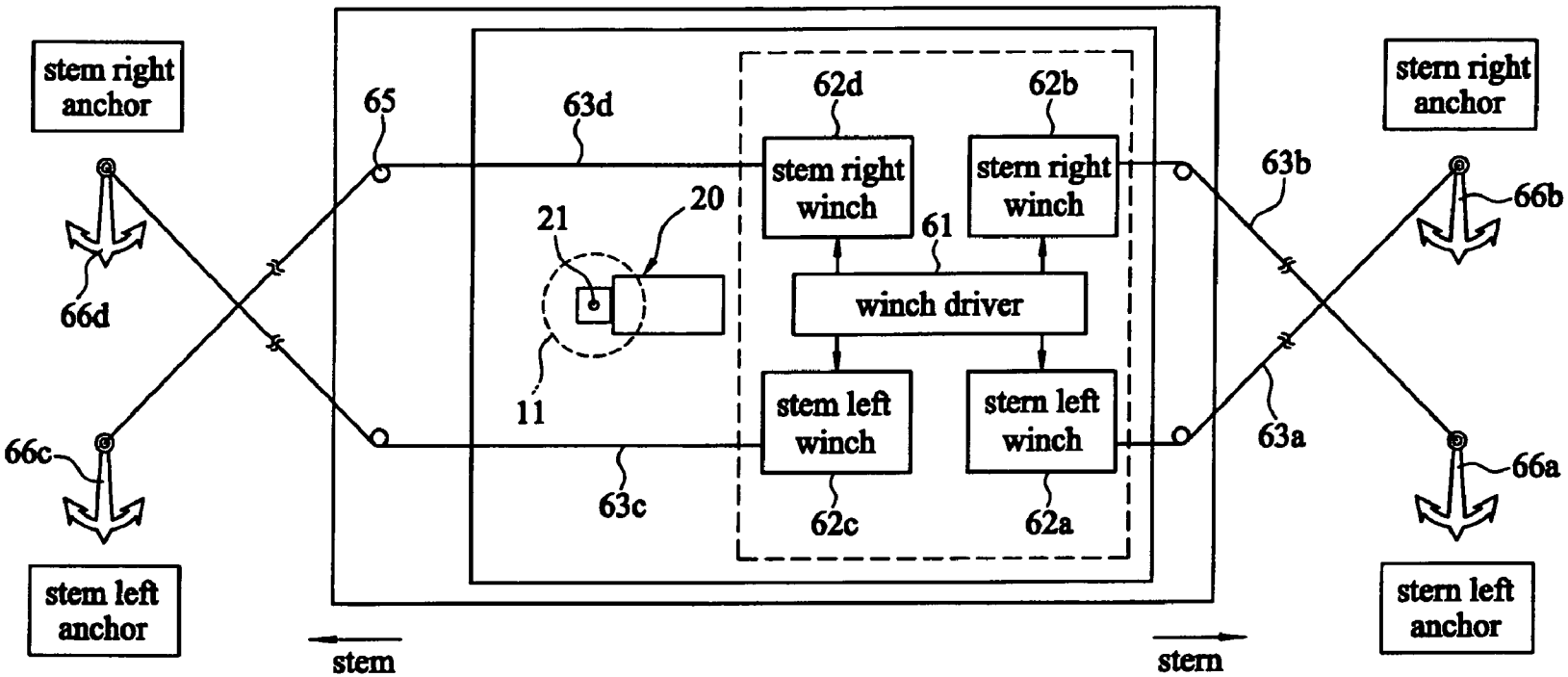
FIG. 8 is a block diagram for illustrating the components of the hull moving means.

The hull moving means 60, as shown FIG. 8, is comprised of plural winches 62*a*~62*d* installed on a barge, a winch driver 61 for driving the winches under command of the controller, and wire ropes 63*a*~63*d* wound on respective winches and connected to anchors 66*a*~66*d* dropped on underwater rocks through guide rollers 64 and direction switch guiders 65 installed on four corners of a barge.

Figure 6:
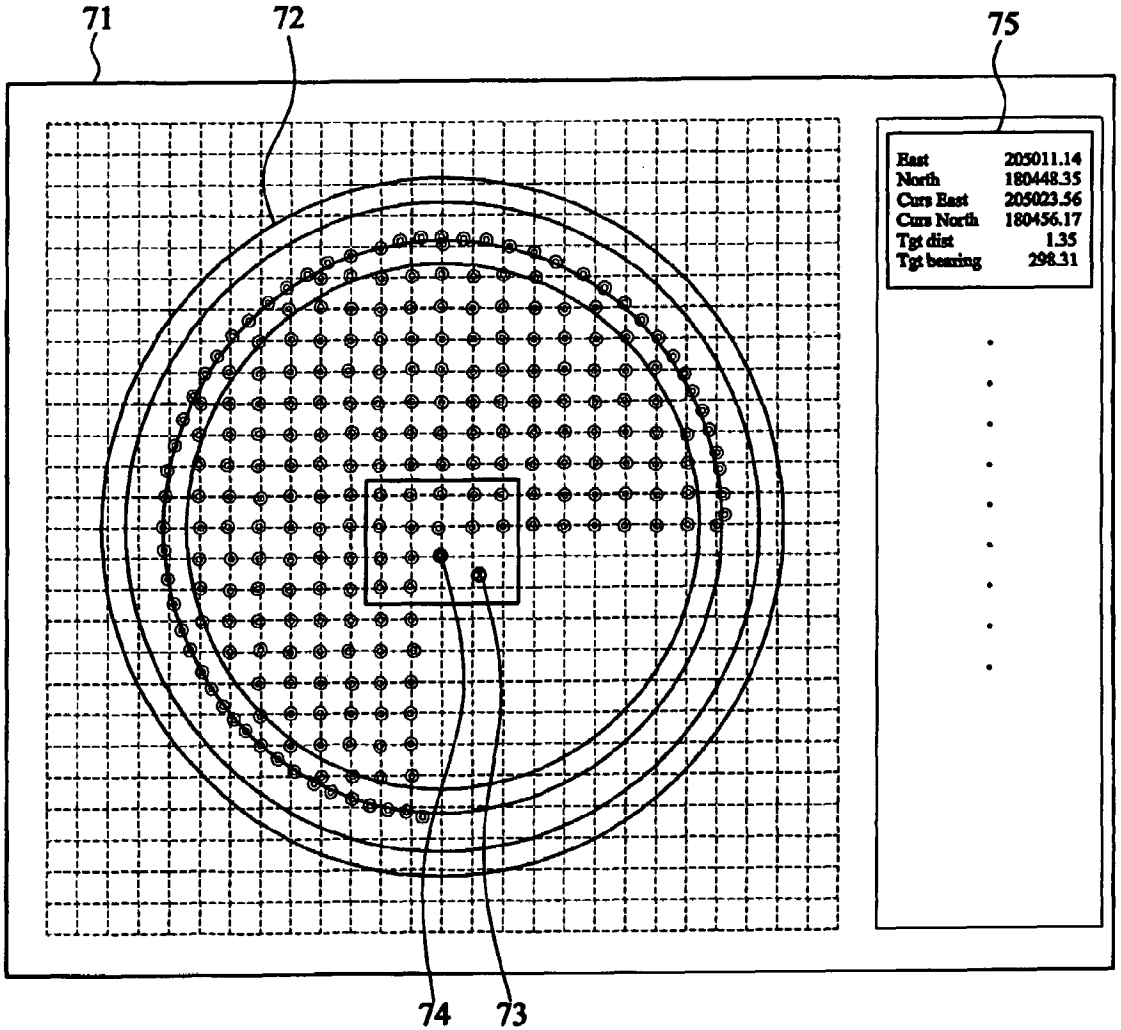
FIG. 6 is a drawing in which a cross-section of the caisson—to be installed at an underwater rock, and a boring map are shown on a displayer.

The display means 70, as shown in FIG. 6, is a monitor 71 that displays the present position of the boring machine, and the position data of the underwater boring target rock and a boring map, and it monitors the whole boring procedure. Further, the display means is comprised of the boring map 72, a mouse cursor 73 which is denoted by "ⓧ" and shows the present position of the boring machine received from the DGPS receiver 31 and the controller, a display mark 74 which is denoted by "ⓞ" and show for displaying the position data of the boring machine and the target position data.

Figure 5:
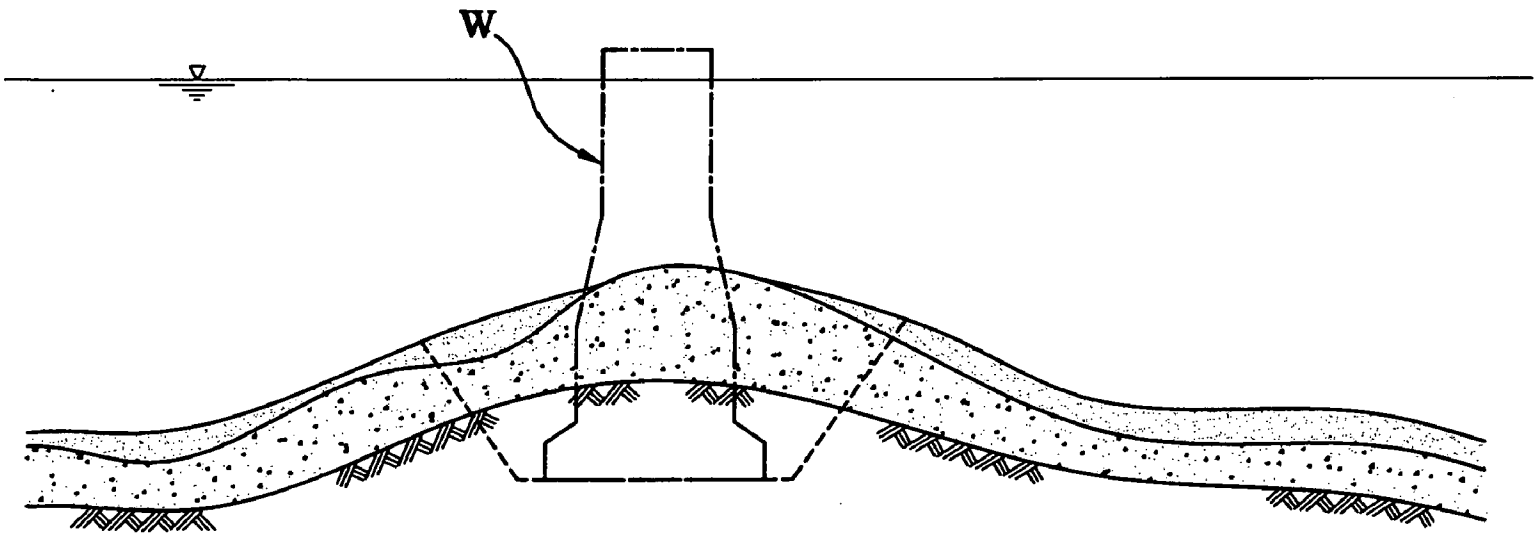
FIG. 5 is a cross sectional view of a caisson which is used as a base for an underwater bridge.

FIG. 5 is a cross sectional view of a caisson which is used as a base for an underwater bridge. The caisson W is installed at a projected area of the underwater rock. The caisson W is shown as a chain line, and the portion shown as the dotted line is the underwater rock area to be eliminated. The drilling is executed on the dotted line area, and a blasting powder is loaded in the drill holes. Next, the blasting work or the crushing rod work takes place so as to eliminate the spur of the rock and get a flattened area. Finally, the caisson is lowered on the surface of a hard rock.

FIG. 6 is a drawing in which a cross-section of the caisson—to be installed at an underwater rock, and a boring map are shown on a displayer. The displayer shows a cursor representing the present location of the boring machine, boring coordinate data for a boring target location, and a coordinate display unit for showing the coordinates of the present location and the target location.

At a steady position of the barge, the monitor 71 displays the boring map 72 of the base of the caisson which is read from the boring data memory means, and the mouse cursor 73—which is denoted by "ⓧ". The monitor receives the data from the DGPS receiver 31 attached on the body of the boring machine and shows the present position of the boring machine under the command of the controller. Further, the monitor 71 displays a display mark 74 which is denoted by "ⓞ" and shows the target boring position, and a coordinate display unit 75 for displaying the present position data of the boring machine and the target position data to be oriented.

The monitor shows that the mouse cursor 73 which is denoted by "ⓧ" shows the present position does not correspond with the display mark 74 which is denoted by "ⓞ" and shows the target boring position.

Therefore, to execute boring work, an operator moves the position of the boring machine to the boring target position that is already oriented. The operator reads on the coordinate display unit 75 of the monitor 71. The operator enters the command through the input means 80 to coordinate the present coordinate data of the boring machine with the boring coordinate data of the boring target position. Under the command of the controller 40, the hull moving means 60 is operated. The position of the boring machine denoted by "ⓧ" is moved to the position of the boring target denoted by "ⓞ" so as to move the hull.

As above, an operator reads the monitor 71, and confirms whether the coordinate of the boring machine is coordinated with the coordinate of the boring target, and operates the boring machine. The rod and bit of the boring machine are lowered through the central opening of a barge to the seabed so as to execute a boring work.

After completing the boring work at the corresponding target position, the rod and the bit of the boring machine 20 lift up at a height that does not interrupt the movement of the boring machine in the underwater. The hull moves to the next target boring position to start the boring work.

At the same way, the mouse cursor lies on the next target boring location. As the mouse clicks, the target boring position is oriented as the "ⓞ" display mark 74 and is shown on the monitor 71. Further, under the command of the controller 40, new boring coordinate data corresponding to the position is read from the boring data memory means 50, and is displayed on the coordinate display unit 75.

As new boring coordinate data is inputted, the controller 40 receives both the "ⓧ" cursor of the mouse cursor 73 (that indicates the position of the boring machine 20) and the coordinate data for the position from the DGPS receiver 31. The controller 40 calculates the difference after comparing it with the new boring coordinate data. According to the result of the calculation, the winch driver 61 operates and the hull moves to new boring target position. The "ⓧ" mouse cursor 73 is corresponded with the "ⓞ" display mark 74. The position of the boring machine is set, and the boring machine is operated to execute the boring work.

Figure 7:
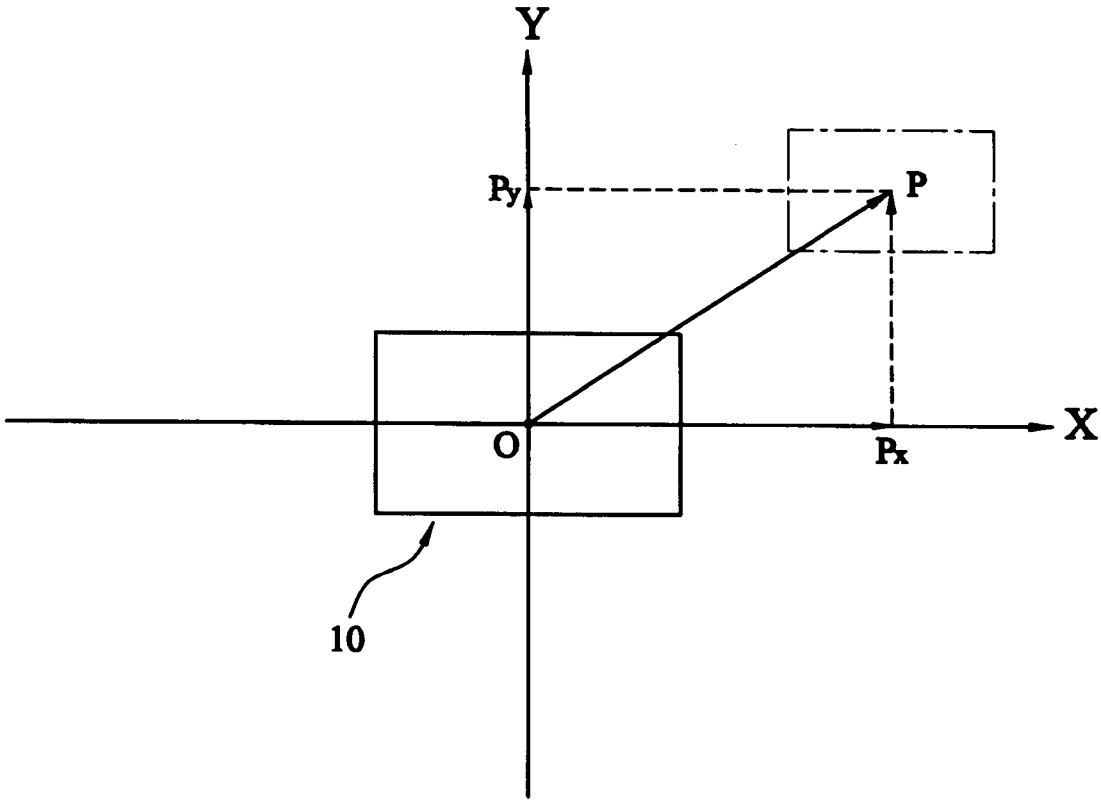
FIG. 7 is a view illustrating a principle of the movement of the barge according to the present invention.

FIG. 7 illustrates a principle of the movement of the barge according to the present invention. The position of the underwater rock boring apparatus is established to locate an origin O that is the center of the barge. A straight line that is extended from the origin O and is parallel to a stern direction is established as the X-axis. A straight line that is perpendicular to the origin O is established as the Y-axis. Therefore, the X-Y plane is established.

As shown in FIG. 7, assuming that the barge 10 moves from the present position O toward the P position on the first quadrantal plane, an operation of the winches is explained.

As the present position of the underwater rock boring apparatus is located on the origin O, and the boring target position of a rock is the P, when the barge moves to the P position, the stern right/left winches 62*c*, 62*d* and the stern left winch 62*a* are operated in a reverse-rotation to release the wire ropes. At the same time, the stem right winch 62*b* is operated in an ordinary rotation to wind the wire ropes, thereby moving the hull.

In addition, to move the position P, the hull is moved to the Px position along the OPx direction, and then is moved to the P position along the OPy direction.

At this time, when the barge moves along the OPx direction, the stem right/left winches 62*c*, 62*d* are operated in a reverse-rotation to release the wire ropes. At the same time, the stern right/left winch 62*a*, 62*b* are operated in an ordinary rotation to wind the wire ropes, thereby moving the hull to the Px position. Next, when the barge moves along the OPy direction, the stem right winch 62*d* and the stern right winch 62*b* are operated in an ordinary rotation to wind the wire ropes. At the same time, the stern left winch 62*c* and the stern left winch 62*a* are operated in a reverse rotation to release the wire ropes, thereby moving the hull to the P position from the Px position.

In another example, sections are established between the origin O position and the target P position. At each section, in the same way already mentioned above, the winches installed at the movement direction of the hull wind each wire rope, and at the same time, the winches that are installed in the opposite direction release each wire rope. The operation is repeated for the hull to reach the P position.

Although another embodiment has not been disclosed, the hull moving means connects to the controller. Also, as the additional means for controlling the operation of the winches, the power as well as the mechanical apparatus of the control box—equipping buttons for controlling winch's rotation direction and its standstill—connect to the controller. It is made clear that respective buttons are operated so as to move the hull.

FIG. 8 is a block diagram for illustrating the components of the hull moving means. The hull moving means 60 is comprised of plural winches 62*a*~62*d* installed on a barge, a winch driver 61 for driving the winches under command of the controller, and wire ropes 63*a*~63*d* wound on a respective winch and connected to anchors 66*a*~66*d* dropped on underwater rocks through a guide roller 64 and a direction switch guider 65 installed on four corners of a barge.

The stern right/left winches 62*a*, 62*b* and the stem right/left winches 62*c*, 62*d* are installed on the barge, respectively. Although the stem right/left winches are installed at the front of the stern right/left winches 62*c*, 62*d*, the extending direction of the wire ropes is changed at the stern by the guide roller 64 and the direction switch guider 65. Therefore, the wire ropes crosses each other and are connected to respective anchors 66*a*~66*d*.

Since the anchors 66*a*~66*d* are dropped on the underwater rock, the position of the barge is dependent on the winding condition of the wire ropes 63*a*~63*d*. The release or the winding of wire rope from/onto respective winches achieves the movement of the hull. Therefore, the position of the boring machine loaded on the barge is decided.

When the barge moves along the stem direction, the winch driver 61 is operated under the command of the controller 40. The stem right/left winches 62*c*, 62*d* are driven in an ordinary rotation so as to wind the wire ropes 63*c*, 63*d*, and the stern right/left winches 62*a*, 62*b* are driven in a reverse rotation so as to release the wire ropes 63*a*, 63*b*. Thus, the hull moves along the stem direction.

In the same way, when the barge 10 moves along the stern direction, the stern right/left winches 62*a*, 62*b* are driven in an ordinary rotation so as to wind the wire ropes 63*a*, 63*b*, and the stem right/left winches 62*c*, 62*d* are driven in a reverse rotation so as to release the wire ropes 63*c*, 63*d*. Thus, the hull moves along the stern direction.

Since respective anchors 66*a*~66*d* are dropped on the underwater rock and are far away from the hull at a predetermined distance (e.g. 150~200 m), the operation of the winches causes the movement of the barge 10, and also causes the position of the boring machine loaded on the center of the barge to change.

The boring method of the underwater rock boring apparatus having a differential global positioning system receiver is explained as follows.

The barge 10 that has the boring machine with the DGPS receiver 31 on the center of the barge moves above the rock to be bored. Anchors of the barge are operated by plural winches 62*a*~62*d* and plural wire ropes 63*a*~63*d*. The anchors are dropped on the rock that is far away from the hull at a predetermined distance and the barge 10 stops.

Next, the boring program installed on the controller 40 operates The controller 40 receives the present position data of the barge from the DGPS 30. The present position data is established on the display means 70. To display the target boring position of the underwater rock on the display means 70, the boring map and the boring data are stored in the boring data memory means 50 through a scanner or a keyboard. Next, the initialization is established.

The target boring position oriented from the boring data memory means and the position of the boring machine 20 inputted from the DGPS 30 are displayed on the display means 70.

It is determined whether or not the position of the target boring corresponds with the position of the boring machine. If it does not correspond, the winch driver 61 is driven under command of the controller 40 so as to move the hull. When the position of the boring machine does correspond with the target boring position, the rod and the bit of the boring machine are lowered through the opening 11 of the barge 10, and start to bore the underwater rock.

The winch driver operates under command of the controller 40. Plural wire ropes 63*a*~63*d* wound on each winch 62*a*~62*d* are connected to respective anchors 66*a*~66*d* through the direction switch guider. The wire rope installed to move in a predetermined direction is wound and the wire rope installed to move in the opposite direction is released, thus achieving the movement of the hull.

Figure 9:
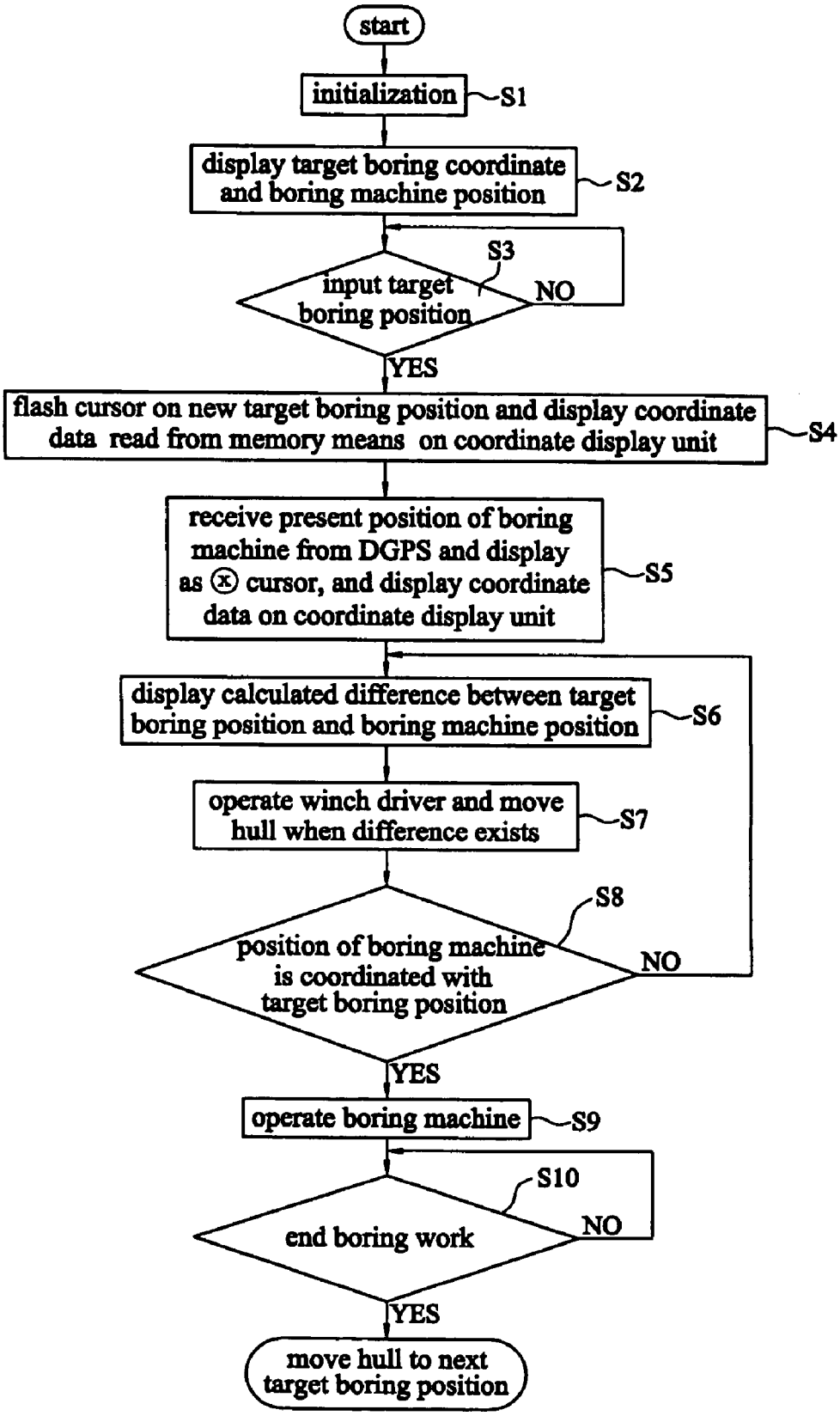
FIG. 9 is a flow chart showing the order of the boring method of the underwater rock boring apparatus having a DGPS receiver for underwater rock.

FIG. 9 is a flow chart showing the order of the boring method of the boring machine having a DGPS receiver for underwater rock. Power is applied to a computer for its initialization. (Step S1). The computer is comprised of a controller 40 having a boring program in its built-in memory, a boring data memory means 50 storing the boring map and its coordinate data, an input means 80 such as a scanner or a keyboard, and a display means 80 such as a monitor.

In step S2, the boring map and the coordinate data which shows the target position data stored in the boring data memory means 50 are inputted along with the position data of the boring machine 20 received from the DGPS 30. The inputted data is displayed on the display means 70 under command of the controller 40.

An operator clicks a mouse at the target boring position and determines whether the position data is inputted (step S3). If the target position is newly inputted, an icon for the target boring position clicked by the mouse is displayed as "ⓞ" on the display mark 74 that will be oriented on the display means 70. The coordinate data for the target boring position reads from the boring data memory means 50 and is displayed on the coordinate display unit 75 (step S4).

The present position of the boring machine 20 received from the DGPS 30 is displayed as "ⓧ" mouse cursor on the display means 70, and the position data for the present position of the boring machine is displayed on the coordinate display unit 75 (step S5).

The variation between the target boring position and the position of the boring machine is calculated and displayed on the coordinate display unit 75 (step S6). When a variation exists, the winch driver 61 operates under command of the controller 40. Plural winches are rotated at in ordinary direction or a reverse direction so as to move the barge 10. As a result, the boring machine 20 corresponds to the target boring position (step S7).

It is determined whether or not the variation between the controlled position of the boring machine and the inputted target boring position is zero (step S8). The winches are operated until the variation is zero, and the barge 10 is moved. When the variation is zero, the winch driver 61 stops and the boring machine operates to execute the boring work (step S9). As the rock boring work for the target boring position is completed (step S10), the hull is moved to the next target boring position.

According to the present invention, the hull moving means can be operated with a simple operation of the controller. The boring machine can move quickly and accurately (approximately 10~20 seconds) to the target boring position for the underwater rock and execute the boring work. Owing to the above method, the boring work for the underwater rock can be executed efficiently. After that, the rock is crushed or blasted, and the debris of the crushed rock is put into a bucket so that the bed of the sea can be flattened. The base of the caisson for a bridge can then be installed.

In the present invention, since the technology of DGPS can be brought to the boring technology, the boring machine installed at the center of the barge can accurately execute the boring work at the target boring position. The present invention has the advantage that inaccuracy is eliminated, and continuous boring work can be executed at the accurate boring position.

Further, the DGPS receiver is attached at a predetermined position from the boring machine, and receives the position data of the boring machine from a satellite and a reference station. As a result, the controller and the hull moving means can move the barge. It has the effect that the established position of the boring work can be set speedily without movement of the boring machine.

In the underwater boring work,, the boring machine is arranged so that there is no direct effect from the external force (e.g. the shock generated by the barge swaying due to the force of waves). As a result, physical effect that is applied to the boring machine can be minimized. Thus, the boring machine is provided at the center of the barge. The stability of the boring work can be secured owing to the ease of the rod connection. No complicated work such as movement, assembly or disassembly of the boring machine is necessary. Speedy boring work can be achieved and the efficiency of the construction can be increased.

In addition, the boring machine can be installed at the center of the barge instead of at the boarder of the barge. It creates convenience of assembly and handling of the rod and the bit. Since the bit has more than 100 mmϕ and the rod has a larger diameter according to the diameter of the bit installed, the boring machine which has a larger diameter can be utilized, and the underwater boring work which has a larger diameter can be executed, thus enabling the blast and crush of the underwater rock to be facilitated.

In the prior art, additional boring work is required because silt surges into the hole that is dug with the smaller diameter and the explosive cannot be loaded. In contrast, in the present invention, no additional boring work is necessary. It has the advantage that stability and efficiency of the rock elimination work can largely be increased. Further, it has economical advantages.

Regardless of the hull swaying, the damage of the rod of the boring machine can be prevented, and the entire procedure can be monitored.

What is claimed is:

1. An underwater rock boring apparatus having a differential global positioning system receiver comprising:

a boring machine installed at the upper portion of an opening in a barge hull, and having a differential global positioning system (DGPS) receiver at a predetermined location of the body thereof;

a differential global positioning system (DGPS) in which the DGPS receiver attached on the boring machine which receives location data from a satellite and a reference station and sends the received data to a control means through a cable;

a boring data memory means for storing a boring map that displays both boring target location of an underwater rock and boring location data that are entered through an input means;

wherein the input means receives the boring target location data of the underwater rock and integrates the location data of the boring machine with the boring target location data;

a display means that respectively displays the location of the boring machine and the boring target location of an underwater rock and monitors the entire procedure;

a hull moving means for controlling a location of the barge hull; and a controller for controlling a response to the boring target location data received from the boring data memory means and the boring machine location data received from the DGPS, the operation of the hull moving means and the data received by the input means.

2. The underwater rock boring apparatus having a differential global positioning system receiver according to claim 1, in which the DGPS receiver is attached at the upper part of the boring machine that is coaxial to the rod of the boring machine.

3. The underwater rock boring apparatus having a differential global positioning system receiver according to claim 1, in which the hull moving means comprises plural winches that are installed on the barge; a winch driver for driving plural winches under command of the controller; and plural wire ropes that are wound on respective winches, and are connected to respective anchors dropped on an underwater rock via direction diverters that are respectively installed at four corners of the barge.

4. The underwater rock boring apparatus having a differential global positioning system receiver according to claim 3, in which the winch driver operates a forward and a reverse rotation and a stop by the operation of each winch under command of the controller.

5. The underwater rock boring apparatus having a differential global positioning system receiver according to claim 1, in which the hull moving means is driven under command of the controller, and winches placed in the same direction as the hull moving direction run to pull the wire rope, and winches placed in the opposite direction to the hull moving direction run to release the wire rope.

6. The underwater rock boring apparatus having a differential global positioning system receiver according to claim 1, in which the input means is a scanner or a keyboard.

7. A boring method using an underwater rock boring apparatus having a differential global positioning system (DGPS) receiver comprising:

a) an initializing set-up step comprising the substeps of:

moving a barge that has the boring machine with the DGPS receiver on the center of the barge above the rock to be bored;

anchoring the barge by operating plural winches and plural wire ropes to drop the anchors on the rock that is far away from the hull at a predetermined distance to stop the barge;

the controller receiving the present position data of the barge from the DGPS;

establishing on the display means the XY plane with the origin of the present position;

storing the boring map and the boring data in the boring data memory means to display the target boring position of the underwater rock on the display means;

b) displaying the target boring position oriented from the boring data memory means and the position of the boring machine inputted from the DGPS on the display means with the XY plane;

c) determining whether or not the position of the target boring corresponds with the position of the boring machine;

d) when the position of the boring machine does not correspond with the position of the target boring, the controller driving the winch driver to move the hull;

e) when the position of the boring machine does correspond with the target boring position, lowering the rod and the bit of the boring machine through the opening of the barge and boring the underwater rock;

f) when the rock boring work for the target boring position is completed, moving the hull to the next target boring position; and wherein the above steps b)~f) are repeatedly performed.

8. The boring method using an underwater rock boring apparatus having a differential global positioning system receiver according to claim 7, wherein the hull location control step (d) and the hull movement step (f) include the following substeps:

the controller operating the winch driver;

providing plural wire ropes wound on each winch are connected to respective anchors through the direction switch guider;

winding the wire rope installed to move in a predetermined direction; and releasing the wire rope installed to move in the opposite direction, thereby achieving the movement of the hull.

* * * * *